United States Patent [19]

Berge

[11] 4,051,565

[45] Oct. 4, 1977

[54] MAT CONVEYOR

[76] Inventor: Trygve Berge, 2 Adams, Apt. 1109, Denver, Colo. 80206

[21] Appl. No.: 708,605

[22] Filed: July 26, 1976

[51] Int. Cl.[2] ..... A47B 83/04; A47C 23/00

[52] U.S. Cl. ..... 5/81 B; 5/92

[58] Field of Search ..... 5/60, 81 R, 81 B, 82, 5/92

[56] References Cited

U.S. PATENT DOCUMENTS

| | | | |
|---|---|---|---|
| 2,918,681 | 12/1959 | Davis | 5/81 C |
| 3,769,642 | 11/1973 | Warman | 5/81 B |
| 3,849,813 | 11/1974 | Neilson | 5/92 |
| 3,978,531 | 9/1976 | Ilon | 5/92 |

*Primary Examiner*—Casmir A. Nunberg

*Attorney, Agent, or Firm*—McCaleb, Lucas & Brugman

[57] ABSTRACT

A lightweight, portable conveyor or transportation unit for moving heavy or fragile objects and which is particularly suited for the movement of injured humans as between supporting carriers, such as hospital emergency carts or tables, and a patient bed, or vice versa. The transportation unit comprises an open-ended, flexible tube-like member, the flexible walls of which collapse inwardly to form a double layer mat having a wear-resistant exterior layer or surface composed of tough flexible material and which may include an under cushion for the support of the patient's body. An inner layer or lining of flexible material having a low coefficient of friction is laminated coextensively over the inner face of the exterior layer. Objects are placed on the upper face of the mat and transported over an undersupporting surface by moving the collapsed flexible walls of the tube transversely of the tubular axis with the interengaged opposing surfaces of the slippery interior lining providing a desired low friction interface between the object and undersupporting surface.

1 Claim, 4 Drawing Figures

MAT CONVEYOR

BACKGROUND OF THE INVENTION

This invention relates generally to the conveyor art and more specifically to lightweight, portable, non-mechanized conveyor means for moving heavy or fragile objects, ill or injured patients and the like.

Under current practice, the movement of an injured or ill human onto an emergency stretcher or between emergency table and operating table or hospital bed usually entails considerable movement and lifting of the patient. Not only is the lifting of a patient, particularly if unconscious, difficult for the handlers, but may aggravate or lead to greater injury or damage. In the case of a back injury, for example, it is most desirable to maintain the patient relatively immobile and to avoid lifting of the body, yet it is obvious that transferring the injured party onto and off of a stretcher, into and out of an ambulance, onto and off of an emergency table and ultimately onto a rest bed or operating table requires a multiplicity of movements. To my knowledge, there is no currently available convenient means of accomplishing these moves except to lift or roll the patient between locations. Several attempts have been made in the past to provide some type of conveyor system for laterally shifting a body, as between an emergency table to a bed and vice versa. Such previous attempts have usually entailed complex mechanisms including conveyor rollers, belts, motors and attending mechanisms. Heretofore, a convenient and successful means for accomplishing this desired end result has not been presented and in those instances where some type of conveyor system has been devised, the mechanisms were usually heavy, cumbersome, relatively fixed, immobile and not readily adaptable to meet the various conditions for both emergency onsite movement of the patient and in-hospital usage. Thus there is a need for a convenient, safer way to transfer patients between hospital emergency and transport tables, carts and beds, operating tables and so forth and which preferably is capable of usage in the field or, that is, in emergency onsite conditions, as in transferring an injured party onto and off of a stretcher.

SUMMARY OF THE INVENTION

In brief, the present invention is directed to a unique and simple solution of the above outlined problem attendant hospital and patient care usage although the field of use is not so limited inasmuch as the concept, operation and structure of features have like applicability to the movement of heavy or fragile objects as in a warehouse, between trucks, onto and off freight carriers and related situations where vertical movement of the object either due to its fragile nature, weight, size or like factors is undesirable and to be avoided as much as possible.

In answer to the above indicated area of need and usage, I have devised a unique open-end tubular, mat-like transfer device or unit capable of being inserted under one edge of an object or patient to be transferred and which extends over an undersupporting surface onto the place or location to which the object or patient is to be moved. The tubular mat is uniquely constructed of flexible material which preferably has a tough wear-resistant exterior surface engageable with the object to be moved and the undersupport therefor and preferably presents relatively good frictional engagement with the object and undersupport. The interior of the tubelike mat is contrastingly provided with a slick or slippery surface, laminated, coated, impregnated or otherwise bonded over the interior of the tubular mat so as to present relatively friction-free opposing surfaces engageable with one another in the collapsed state of the mat. Movement of the object is accomplished by forcing the same laterally or transversely of the tubular axis of the mat so as to interengage the relatively friction-free inner surfaces and moving the same over one another, whereby to effect the desired transfer or transporting movement.

It is among the important objects of this invention to provide a new, improved and safer way to transfer sick or injured patients between locations.

A further object of this invention is to provide an improved, simplified and non-mechanized, lightweight portable transfer unit having particular utility in the movement of injured or otherwise immobilized humans.

Still another object of this invention is to provide an improved lightweight portable transfer unit, as aforesaid, having capability of moving heavy and fragile objects generally horizontally for limited distances and with minimum vertical movement of the objects onto and off of the transfer unit.

Still another object of this invention is to provide an improved transfer unit for conveying or moving objects limited distances over undersupporting surfaces which comprises a continuous open-ended, tubelike member of flexible material, or materials, distinguished by relatively friction-free interior walls whereby opposed surface portions thereof are interengageable with a relatively friction-free interface to effect relative movement therebetween.

Still another object of this invention is to provide an improved tubelike transversely endless mat for moving fragile or heavy objects and injured or ill patients distinguished by a tough flexible exterior having a relatively high coefficient of frictional engagement with the object and undersupport and a relatively low or friction-free inner surface whereby opposing portions of said inner surface provide a slippery and generally friction-free interengaging means for easy transfer of objects in directions transverse of the mat's tubular axis.

Having thus described the present invention, the above and other objects, features and advantages thereof will be readily recognized by those familiar with the art from the following detailed description of a preferred embodiment thereof illustrated in the accompanying drawings, and representing the best mode presently contemplated for enabling those familiar with the art to practice this invention.

IN THE DRAWINGS

Figure 1:
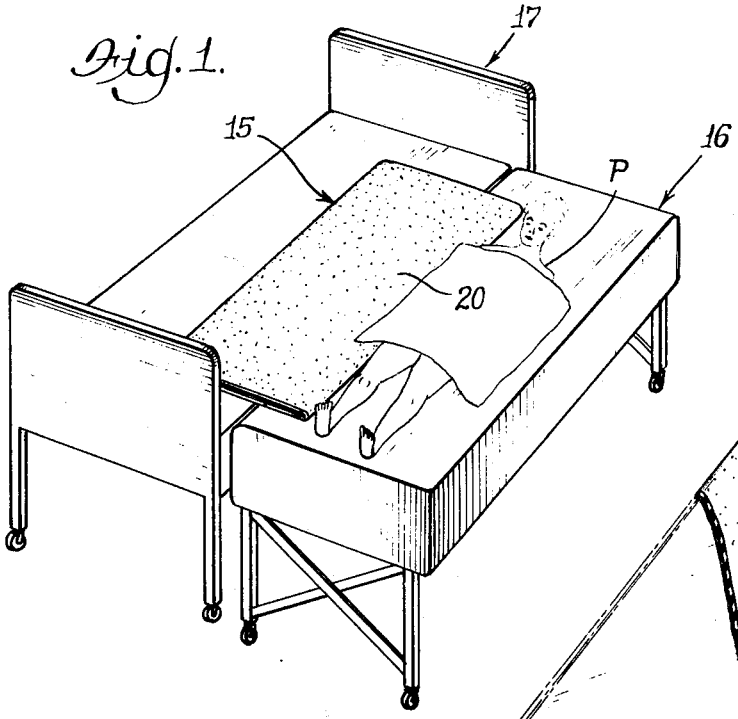
FIG. 1 is a perspective illustration of a hospital bed and emergency cart equipped with the improved mat conveyor of this invention for transferring a patient therebetween.

Turning now to the particulars of the present invention and the illustrated preferred embodiment as the same relates to the movement of an ill or injured human, it will be appreciated from FIG. 1 in particular that the mat 15 is shown in position bridging the gap between emergency cart 16, or the like, and a hospital bed 17 for movement of the illustrated patient P from the cart to the bed, or vice versa.

Figure 2:
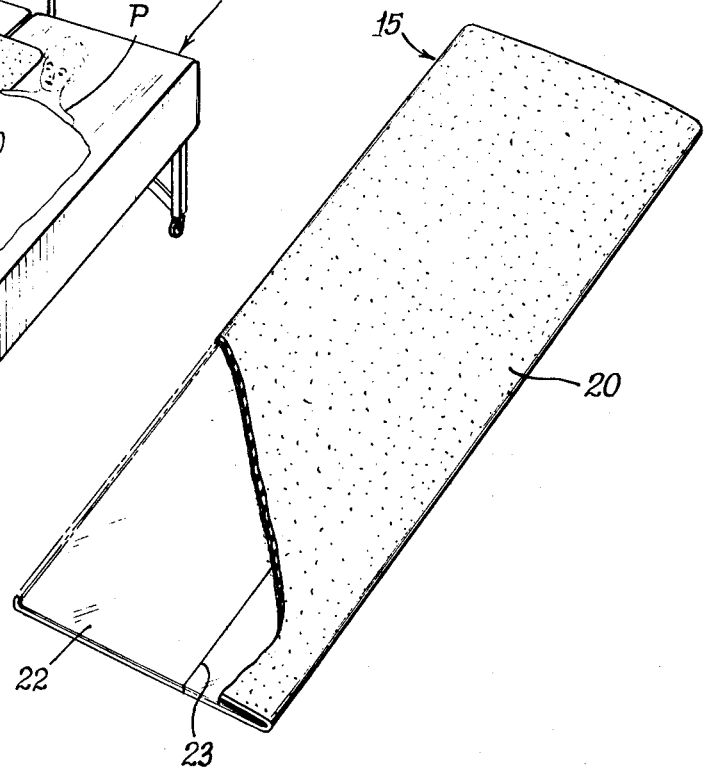
FIG. 2 is an enlarged perspective view of the conveyor mat illustrated in FIG. 1, with portions broken away in section to illustrate its structural features.

As shown, the conveyor mat 15 is formed as a flexible and collapsible transversely endless tube, which in the case of patient transfer, may be sized in the order of 6 feet in length and 2 feet in width in its collapsed state, illustrated in FIG. 2. In this regard, the particular dimensions of the mat are dependent more or less on the size of the object to be moved and the desired movement distance as will appear more clearly from a description which follows.

Figure 3:
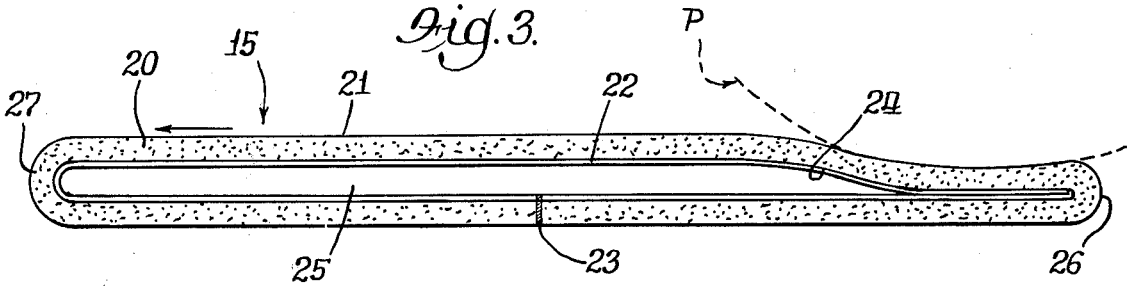
FIG. 3 is an end elevational view of the conveyor mat according to this invention, showing its operational mode for engaging and moving objects.

With particular reference to FIGS. 2 and 3, it will be recognized that the illustrated tubular mat 15 is constructed as a laminate to include an outer layer 20 of tough flexible material and preferably providing a wear-resistant exterior surface 21, productive of relatively high frictional interengagement with the object or patient to be moved and an undersupporting surface. In the particular illustrated instance, layer 20, for patient comfort reasons, is preferably constructed as a cushion layer and to that end may be foam rubber or an expanded foam plastic or synthetic material, such as vinyl foam. Depending on the intended usage of the mat, the outer layer 20 may constitute such materials as leather, plastic sheet material, such as polypropylene, canvas, synthetic fabrics, or the like, capable of providing a good wear-resistant, frictional outer surface which is productive of relatively good frictional engagement with the object of the mat's undersupport.

The interior of the illustrated tubelike mat, by way of contrast, comprises a layer, coating or impregnation 22 of relatively friction-free material, that is, material having a generally low coefficient of friction surface. Workable examples are woven fiber glass, silk, nylon, acrylic or similar plastics; polyflurocarbon synthetics, such as Teflon, and impregnating or lubricating agents such as silicone. For patient use as illustrated, the preferred materials for the outer wear layer 20 are foam rubber or foam plastic, such as foam vinyl, while that for the inner layer 22 is nylon or Teflon in sheet or woven or coated fabric form. Be that as it may, the construction of the tubular mat in accordance with the illustrated case for patient usage comprises coextensive laminations of the two layers 20 and 22 from superposed sheet materials which are suitably bonded, adhered or integrally interjoined and then folded into transversely endless tubular continuity. Interjunction of the opposing layer ends may be by a plastic weld or seam 23 so as to form the endlessly continuous tubular formation required. In this regard, it is to be understood that the tubular mat may be formed as a seamless member of tubular layers or may have abutting end edges as shown or overlapping end edges suitably interstitched or joined, all of which detail of construction is of no specific moment to the concept of the features of the current invention other than by way of providing a continuous collapsible tubular member. Similarly, while layers of plastic foam and Teflon are illustrated in the specific preferred case, such tubular member may be constructed other than by laminating dissimilar materials, as for example by the coating or impregnating one surface of a canvas or synthetic fabric with a slick or slippery substance such as silicone to provide the relatively friction-free interengaging surfaces requisite to the operation of the invention. Regardless of the mode of construction adopted and the particular material, or materials, selected, in general it may be stated that it it preferable to have the exterior layer 20 provide a relatively good wear-resistant frictional outer surface while the interior layer 22 or surface must be of relatively low friction character to provide the slippery or slick interengaging surfaces. Further, while the illustrated mat for patient use includes a foam rubber or other spongy outer layer 20 for comfort purposes, such is not essential, particularly if the desired use is that of transporting or moving inanimate objects where the comfort factor is not of any particular moment.

USE AND OPERATION

Specifically, in the laminated construction illustrated, it will be appreciated that the Teflon inner layer 22, for example, provides opposing faces 24 and 25 comprising the continuous interior wall of the tubelike mat. These surfaces operationally engage one another in the collapsed state of the mat to provide the relatively friction-free surfaces requisite for translating the object transversely of the tubular axis. For example, FIG. 3 illustrates the initial location of the mat beneath one margin or edge of the patient P as by tucking the same under the hip and shoulder areas. This may be accomplished conveniently by only slightly lifting or rolling the patient while inserting the right-hand margin 26 of the mat 15 under the body sufficiently to produce the indicated supporting engagement therebetween. As such, the two inner surfaces 24 and 25 are pressed into opposing engagement beneath the patient or load while the remaining portions of such surfaces remain relatively free or slightly spaced from one another.

Figure 4:
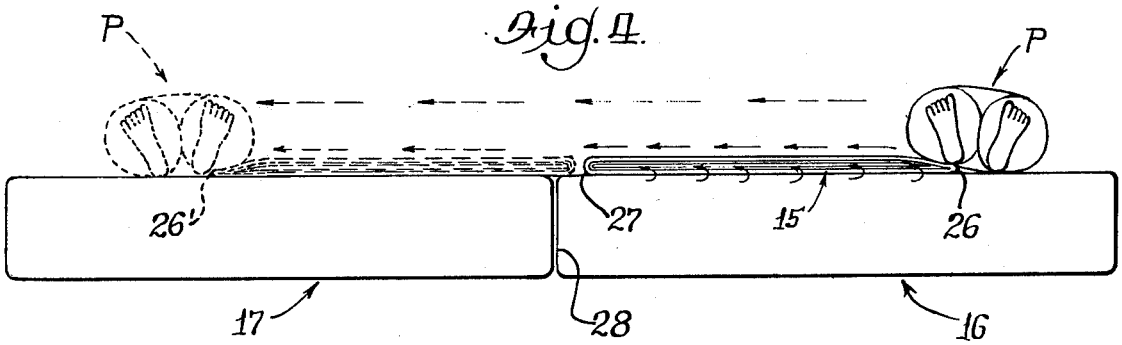
FIG. 4 is a schematic illustration of the conveyor mat of this invention in operation for moving a patient between the emergency cart and the rest bed illustrated in FIG. 1.

As best illustrated in FIG. 4 of the drawings, operational movement of a patient P between the emergency table 16 and the hospital bed 17 is initiated with the mat 15 located beneath one side or lateral margin of the patient sufficiently to effect necessary engagement between the exterior layer surface 21 and the body of the patient. The mat, as shown, preferably is disposed lengthwise of the patient and the emergency bed 16, with the free or non-load bearing edge 27 of the mat adjacent one edge 28 of the emergency table 16. Once the patient is so engaged with the upper surface of the mat 15, movement laterally onto the upper surface of the hospital bed 17 is effected simply by thrusting or pulling the patient's body transversely of the mat's tubular axis which causes the slippery inner surfaces 24 and 25 to ride easily over or on one another pushing the non-load bearing remainder of the mat in advance of the body or to the left as shown in FIG. 4. This action effectively translates the upper portion of the collapsed mat over the lower portion thereof with the tubular construction of the mat permitting continuous movement. In practice, the translation of the load or patient is substantially twice the distance of the mat's lateral dimension and therefore, as illustrated in FIG. 4, the patient may be successfully moved from bed 16 to bed 17 with a minimum of effort and disturbance. It will be appreciated that when the patient has been translated to desired location on the hospital bed 17, the margin 26 of the mat initially beneath the patient's right hand side in FIG. 4, is now beneath his left hand side, as indicated at 26'. The mat then may be withdrawn from beneath the patient with minimum disturbance and patient discomfort.

From the foregoing it is believed that those familiar with the art will readily recognize the unique character and advancement of the current invention over the prior art. The improved transfer or conveyor mat of this invention meets the objectives of convenience, simplicity, lightweight construction and easy portability and provides an effective and simplified non-mechanical transfer system or means for moving patients or other objects over an under-supporting surface with minimal effort. Furthermore, inasmuch as the mat is preferably made of readily flexible materials, the same readily may be folded and stored when not in use, thus avoiding objectionable cumbersome and heavyweight features of the heretofore known conveyor systems and means. Additionally, while the preferred form of this invention has herein been described and illustrated in conjunction with the horizontal transfer of a human patient, such is for illustrative purposes only, both as to usage and transfer conditions. The same is also operabe along non-horizontal supporting surface or slopes with the use of an inclined sheet of plywood or other support ramp. Thus the mat of this invention is readily adapted for moving and elevating a patient onto an emergency stretcher from the ground level with a minimum disturbance and manual lifting of the body.

Additionally, as pointed out hereinabove, while the present preferred form of the invention is shown as comprising a laminate of foam-like cushion material for the exterior outer layer thereof and a Teflon coated or other slippery fabric inner layer, it is fully contemplated that a single flexible material, such as woven fiber glass fabric, for instance, having a smooth, hard woven and slippery inner surface, exhibiting a relatively low coefficient friction, and a tough, relatively wear-resistant textured outer surface of good friction productive engagement with the object and undersupport therefor may be used, so that laminated construction is not necessary to the practice of this invention. Also, it is readily apparent that as opposed to the laminated construction illustrated, the inner layer may be coated or lubricated with a slippery substance to effect the desired low frictional interface requisite to the translating conveyor action described.

Thus, it will be understood that while the current invention has been described and illustrated in accordance with a particular preferred embodiment, specifically directed to the transporting or movement of injured or ill humans, its merits, concepts and scope are not to be so limited, either as to the described preferred materials, as presently conceived, or to the specific structural aspects described and shown except as may appear in the following appended claims.

The embodiments of the invention in which an exclusive property or privilege is claimed are defined as follows:

1. A lightweight, portable conveyor for moving objects over an undersupporting surface, consisting of an open ended, flexible walled, radially collapsible, seamless tubular member dimensioned to at least coextend with the underside dimensions of an object to be moved, said member being made up of two concentrically laminated cylindrical layers of dissimilar flexible materials; the outer one of said layers being relatively thick spongy material selected from the group of foam rubber and expanded foam plastic and having an exterior surface of relatively high frictional quality for frictionally coupling the tubular member to the underside of said object and an undersupporting surface; and the inner one of said layers being relatively thin plastic material having the general anti-friction characteristics of polytetrafluoroethylene resin whereby opposed surface portions of said inner layer are interengaged in the radially collapsed state of said member and are slidingly movable over one another with little frictional resistance under the weight of the object to facilitate moving the latter in directions transversely of said member's tubular axis.

* * * * *

UNITED STATES PATENT OFFICE

CERTIFICATE OF CORRECTION

Patent No. 4051565 Dated October 4, 1977

Inventor(s) Trygve Berge

It is certified that error appears in the above-identified patent and that said Letters Patent are hereby corrected as shown below:

Col. 3 Line 35: "of" should be --and--

Signed and Sealed this

*Thirty-first* Day of *January 1978*

[SEAL]

*Attest:*

RUTH C. MASON
*Attesting Officer*

LUTRELLE F. PARKER
*Acting Commissioner of Patents and Trademarks*